US005583832A

United States Patent [19]

DePonty

[11] Patent Number: 5,583,832

[45] Date of Patent: Dec. 10, 1996

[54] MEDICAL TIMER, AND METHODS OF CONSTRUCTING AND UTILIZING SAME

[75] Inventor: Ernest DePonty, Spokane, Wash.

[73] Assignee: Accucure, L.L.C., Spokane, Wash.

[21] Appl. No.: 319,652

[22] Filed: Oct. 7, 1994

[51] Int. Cl.[6] ..... G04B 47/00; H01H 43/14

[52] U.S. Cl. ..... 368/10; 368/309; 307/141.4

[58] Field of Search ..... 368/619, 10, 12, 368/107–113; 5/607–610, 510; 307/141, 141.4; 340/309.15, 309.4

[56] References Cited

U.S. PATENT DOCUMENTS

| | | | |
|---|---|---|---|
| D. 262,216 | 12/1981 | Yoshimoto . | |
| 3,663,830 | 5/1972 | Miller | 307/141 |
| 3,840,924 | 10/1974 | Hamilton . | |
| 4,588,303 | 5/1986 | Wirtschafter et al. . | |
| 4,725,999 | 2/1988 | Tate . | |
| 5,088,056 | 2/1992 | McIntosh et al. . | |
| 5,160,831 | 11/1992 | Thaler et al. | 219/506 |
| 5,224,496 | 7/1993 | Palmer et al. | 128/869 |
| 5,230,113 | 7/1993 | Foster et al. . | |
| 5,365,496 | 11/1994 | Samilow | 368/109 |
| 5,502,853 | 4/1996 | Singleton et al. | 5/609 |

*Primary Examiner*—Vit W. Miska

*Attorney, Agent, or Firm*—Weiner, Carrier & Burt, P.C.; William F. Esser; Irving M. Weiner

[57] ABSTRACT

A medical timing device for administering to the medical treatment of patients whom are confined to a bed or wheelchair. The invention comprises a first timing unit for measuring an interval of time having a programmable duration; an actuator for activating the time measurement of the programmable time interval; a plurality of switches, each of which corresponds to a distinct, predetermined medical treatment; and a visual indicator for indicating the completion of the measuring of the programmable time period by the first timing unit, and for indicating the selected medical treatment to be performed.

20 Claims, 1 Drawing Sheet

MEDICAL TIMER, AND METHODS OF CONSTRUCTING AND UTILIZING SAME

BACKGROUND OF THE INVENTION

1. Field of Invention

This invention pertains to a device for efficiently administering periodic medical treatments, and particularly to a programmable medical timer for use in changing the bed positions of a patient who is confined to a bed.

People who are substantially confined to a bed or wheelchair experience an increased risk of contracting a plurality of harmful conditions. Such conditions are caused in part due to a person's body being placed in the same position in a bed or wheelchair for prolonged periods of time, which may restrict blood flow to major body parts or continually apply a person's entire body weight to small portions of his/her body; or due to a person's skin being exposed to a skin irritant for prolonged periods of time.

For example, decubitus ulcers (the degeneration of skin tissue) may be caused by restricted blood and/or oxygen to portions of the body, or by prolonged contact with skin irritants such as urine. Medical techniques used in treating decubitus ulcers include skin grafts. Advanced stages of decubitus ulcers pose significant threats to the patient from other infections, such as mild bacterial and vital strains, as well as to potentially life-threatening strains such as staph infections. Decubitus ulcers and other similar conditions pose a heightened danger to the elderly, who experience an increased risk therefrom because of the existence of muscle loss stemming from the aging process.

In addition, ineffective management to bodily waste, or prolonged exposure thereto may not only spread bacteria and other organisms, but may also lead to irritating rashes, urinary tract infections (UTI), or yeast infections.

The above-mentioned physical conditions are known to lead to potentially harmful and permanent psychological conditions or disorders in persons having same, ranging from experiencing low self-esteem to depression.

Accordingly, preventive measures to reduce the occurrence of the above-mentioned conditions include periodic medical treatments. To avoid decubitus ulcers or other similar conditions stemming from blood flow restriction, health care professionals reposition a bed-confined patient within every two hours, and apply topical lotions on a regular, periodic basis. To avoid complications stemming from prolonged contact with bodily waste, health care professionals keep the incontinent patients clean and dry through periodic cleanings, periodic applications of powders or lotions, or periodic management of medical devices such as catheters or colostomy bags. However, these preventive measures are only effective if followed on a periodic and substantially continual basis.

2. Description of the Relevant Art

There are known timing devices for administering the taking of medicine. For example, Wirtschafter U.S. Pat. No. 4,588,303, McIntosh U.S. Pat. No. 5,088,056, and Tate U.S. Pat. No. 4,725,999 disclose a timer apparatus which monitors and/or records the receiving of medicine.

The above-identified patents, however, fail to disclose a medical timing apparatus for administering the repositioning of patients confined to a bed or wheelchair, having means for selecting from a plurality of predetermined time periods and from a plurality of predetermined bed positions.

Foster U.S. Pat. No. 5,230,113 discloses a multiple position day/night bed, including adjustment controls having means for controlling the speed of adjustment. Foster, however, fails to disclose a medical timer for administering to a patient confined to a bed and to a wheelchair, having controls for selecting from a plurality of positions in which to orient a patient, and associated alarms.

Yoshimoto U.S. Pat. No. Des. 262,216, and Hamilton U.S. Pat. No. 3,840,924 disclose headboard mountable clock radios, but fail to disclose a medical timer for administering to a person who is confined to a bed or wheelchair.

SUMMARY FOR THE INVENTION

The present invention overcomes the above-discussed limitations and shortcomings of known medical timers and satisfies a significant need for a bed position timer which allows the user thereof to program both the specific bed position desired and the time period between repositioning, and which quickly and easily alerts the health care provider of the need to change a patient's orientation within her bed.

According to the invention, there is provided a timing device having a first timer for measuring a programmable time interval; a plurality of switches, each of which corresponds to orienting a patient into a unique position, the activation of such a switch activates the first timer; a first visual indicator for alerting the health care provider of the completion of the programmable time interval; a second timer for measuring a predetermined time interval following the completion of the programmable time interval; and a second visual indicator for alerting the health care provider of the absence of reactivation of the first timer within the predetermined time interval.

In use, the health care provider first selects the desired programmed time interval from a plurality of predetermined time intervals. Next, the provider selects the desired position in which to orient the patient after the expiration of the programmed time interval, which thereby activates the first timer unit in measuring the selected time interval. When the selected time interval has elapsed, the first indicator visually alerts the health care provider of the elapsed period and the selected bed position. Thereafter, the provider may select the next bed position in which to orient the patient (which again reactivates the first timer unit), and optionally select a new time interval. If the provider fails to reactivate the first timer unit (so as to begin measuring a subsequent selected time interval) within the predetermined time interval, the second indicator visually alerts the provider of this failure.

In an alternative embodiment, the timing apparatus mounts to the back of a wheelchair so as to provide a timing device for administering to patients whom are incontinent. This embodiment includes the selection from a plurality of predetermined cleaning or waste management treatments.

It is an object of the invention to provide a timing apparatus for effectively managing the repositioning of a patient confined to a bed.

It is another object of the invention to provide such a timing apparatus which is inexpensive to manufacture so that an apparatus may be associated with each bed in a health care facility.

Still another object of the invention is to provide a timing device having means for selecting and indicating a desired position in which to orient a bed-confined patient from a plurality of predetermined positions.

Another object of the invention is to provide a timing apparatus which alerts the health care provider of the time in which to reposition a bed-confined patient, and a second time in which the need to reposition a bed-confined patient is enhanced.

Further, another object of the invention is to provide a timing apparatus for effectively managing the treatment of the incontinent.

Other objects, advantages and salient features of the present invention will become apparent from the following detailed description, which, when taken in conjunction with the annexed drawings, discloses preferred embodiments of the present invention.

DETAILED DESCRIPTION OF THE INVENTION

Figure 1:
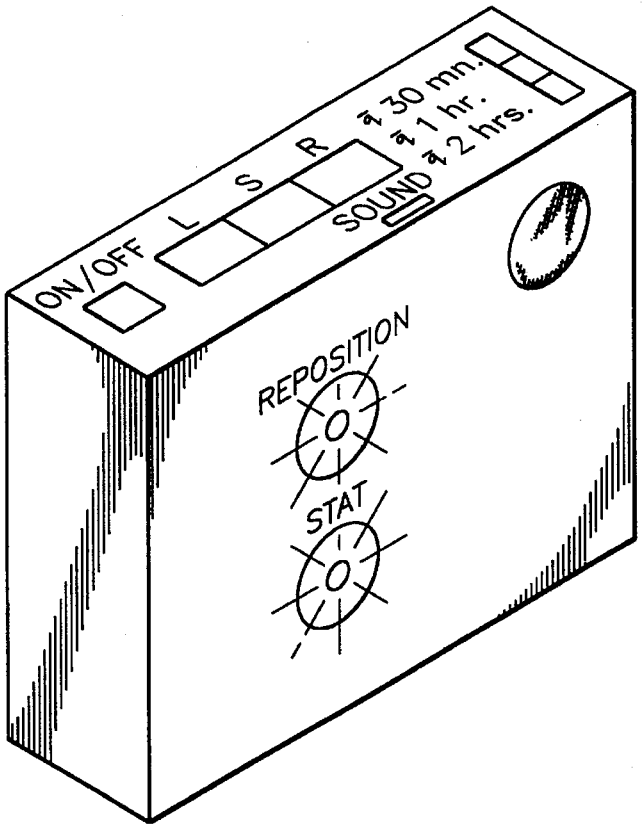
FIG. 1 is a perspective view of a preferred embodiment of the present invention.

Referring to FIG. 1, there is shown a medical timing apparatus 1 comprising, medical treatment controls 2, time interval controls 3, first visual indicator 4, second visual indicator 5, audio control 6, audio indicator 7, cycle control 8, and power switch 9.

According to the invention, the medical timing apparatus 1 preferably but not necessarily includes means for selecting from a plurality of predetermined medical treatments, any of which may be performed after the passing of a time interval. In a preferred embodiment, selection means 2 comprises a plurality of switches, each of which corresponds to a predetermined medical treatment, such as repositioning a bed-confined patient. As shown in FIG. 1, electronic switches 2*a*, 2*b*, and 2*c* are preferably located along the top portion of medical timing apparatus 1 for easy access thereto by a health care provider.

Switches 2*a*, 2*b*, and 2*c* preferably but not necessarily correspond to orienting a patient on the patient's left side, in the supine position, and on the patient's right side, respectively. Although switches 2*a*, 2*b* and 2*c* may be independently activated, switches 2*a*, 2*b*, and 2*c* are preferably electronically or mechanically interrelated so that no two of them may be concurrently activated.

Medical timing apparatus 1 preferably but not necessarily includes means for visually indicating the selection of a medical treatment, comprising a plurality of light sources, each of which is arranged adjacent or underneath (in the case wherein switches 2*a*, 2*b* and 2*c* include opaque cover plates) a corresponding switch. In this way, when one of switches 2*a*, 2*b* or 2*c* is selected, its corresponding light source is activated so that medical timer 1 alerts any user thereof of the selected medical treatment.

According to a preferred embodiment of the invention, medical timing apparatus 1 preferably but not necessarily includes means for programming a time period after which a selected medical treatment, such as the repositioning of a bed-confined patient or a treatment for the incontinent, will be performed. As shown in FIG. 1, the programming means preferably but not necessarily comprises a plurality of switches 3*a*, 3*b*, and 3*c*, each of which corresponds to a predetermined interval of time. In a preferred embodiment of the invention, switches 3*a*, 3*b*, and 3*c* preferably but not necessarily correspond to time intervals of 30 minutes, one hour, and two hours, respectively.

As is similar to switches 2*a*, 2*b*, and 2*c*, switches 3*a*, 3*b*, and 3*c* may be independently activated, but preferably they are electronically or mechanically interrelated so that no two of switches 3*a*, 3*b*, or 3*c* may be concurrently activated. Once one of switches 3*a*, 3*b*, or 3*c* is activated, its corresponding time interval is stored in memory. As shown in FIG. 1, electronic switches 3*a*, 3*b*, and 3*c* are preferably located along the top portion of medical timing apparatus 1 for easy access thereto by a health care provider.

Medical timing apparatus 1 preferably but not necessarily includes means for visually indicating the selected switch 3*a*, 3*b*, or 3*c*, comprising a plurality of light sources, each of which is arranged adjacent or underneath (in the case wherein switches 3 include opaque cover plates) the corresponding switch 3*a*, 3*b*, or 3*c*. In this way, when one of switches 3*a*, 3*b* or 3*c* is selected, its corresponding light source is activated so that medical timer 1 alerts any user thereof of the selected time interval.

According to a preferred embodiment of the present invention, medical timing apparatus 1 preferably but not necessarily includes a means for measuring a programmed interval of time corresponding to a time interval after which a selected medical treatment is to be performed. The time measuring means is programmed to measure the desired time interval which is selected from the plurality of predetermined time periods, through activation of one of switches 3*a*, 3*b*, or 3*c*. Once programmed, the time measuring means is initiated or activated by the selection of the desired medical treatment from the plurality of predetermined treatments corresponding to switches 2*a*, 2*b*, and 2*c*.

The present invention preferably includes a means for determining the completion of the measured time period (as measured by the time measuring means), and for indicating the completion to the users thereof. The indicating means preferably but not necessarily includes a visual indicating means comprising a light source 4. In a preferred embodiment, when the selected time period has elapsed as determined by the time measuring means, the time measuring means signals to the indicating means of the completion, whereupon light source 4 is illuminated to flash in a periodic manner. In this way, any health care provider is quickly alerted of the need to perform the medical treatment selected from switches 2*a*, 2*b*, and 2*c*.

Further, in the event the health care provider fails to perform the desired medical treatment at the completion of the selected time period, the present invention preferably but not necessarily alerts the provider of a heightened need to perform the desired treatment. Specifically, the present invention preferably includes a means for determining an absence of the above-mentioned time measuring means being reprogrammed and/or reactivated within a predetermined time interval following the elapse of the selected or programmed time period, comprising a second time measuring means for measuring the predetermined time interval substantially immediately following the elapse of the programmed time interval activated by selection of one of switches 2*a*, 2*b*, and 2*c*; means for recording the reactivation of the first time measuring means within the predetermined time interval; means for generating a signal at the completion of the predetermined time interval based upon such recording; and second means for indicating the absence of reactivation within the predetermined time interval.

As shown in FIG. 1, the second indicating means comprises light source 5, which when activated periodically flashes a light. In order to more clearly alert the health care provider of the heightened need to apply medical treatment to the patient, light source 5 preferably but not necessarily illuminates a light having a different color than light source 4. In an alternative embodiment, light source 5 illuminates a flashing light having a different frequency from the flashing light source 4.

According to a preferred embodiment of the present invention, medical timing apparatus 1 includes means for selectively audibly indicating the elapse of the selected time period, and the absence of reactivation of the first time measuring unit within the predetermined time period following the selected time period. As shown in FIG. 1, such audio means includes speaker 7, which is electrically connected to the first time measuring unit and the signal generation means of the second time measuring unit.

Speaker 7 preferably but not necessarily generates a first audible sound following the elapse of the selected time period, and a second audible sound following the elapse of the predetermined time period if the first time measuring unit is not reactivated therewithin. The second audible sound is preferably but not necessarily distinct from the first audible sound, so that the health care provider is more easily alerted to the heightened need to perform the desired medical treatment. Sound activating switch 6 provides selective control of the audio indicating means.

Figure 2:
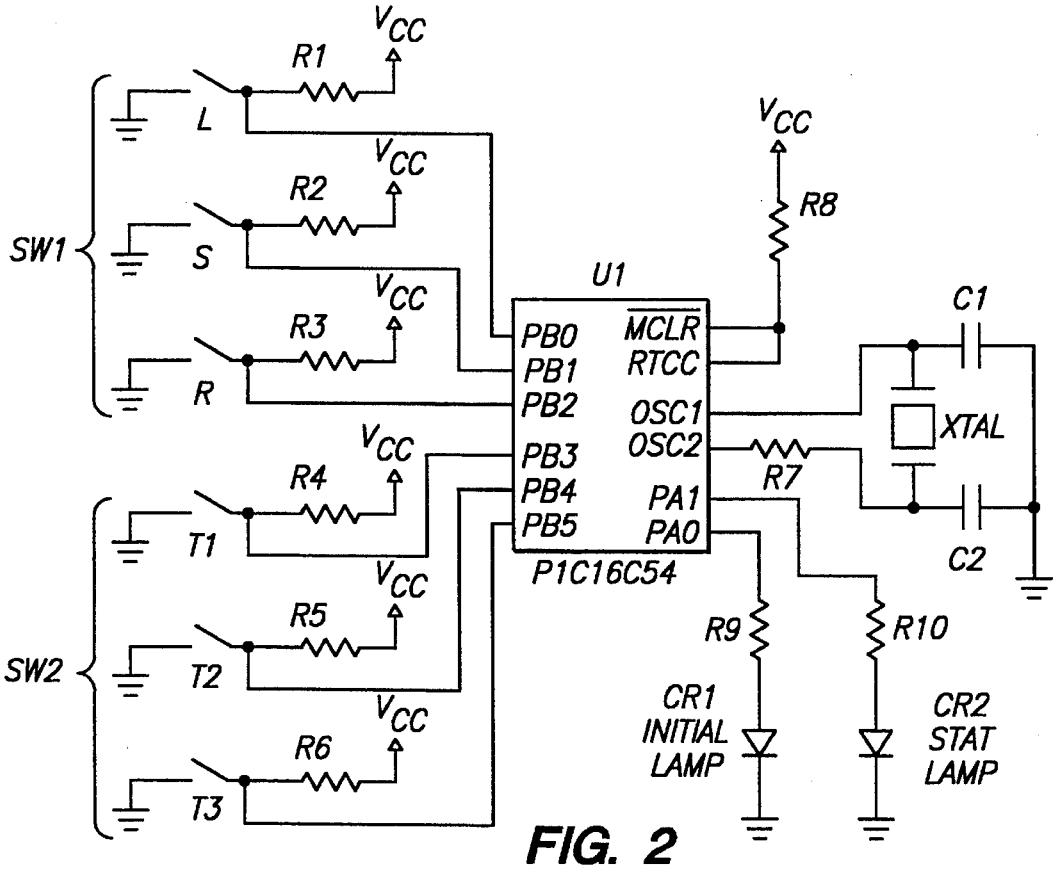
FIG. 2 is a circuit diagram of a preferred embodiment of the present invention.

The first time measuring means and second time measuring means preferably but not necessarily each comprises a counter circuit for measuring a time interval. Such counters, together with the control and timing circuitry for storing the selected time interval corresponding to switches 3*a*, 3*b*, and 3*c*, for operating light sources 4 and 5, for generating audio signals from speaker 7, and for recording the reactivation of the first time measuring means are preferably but not necessarily implemented on a single integrated circuit chip in order to reduce manufacturing costs and to improve performance. As shown in FIG. 2, medical timing apparatus 1 is preferably implemented from a standard integrated circuit chip connected to switches 2*a*, 2*b*, and 2*c*, switches 3*a*, 3*b*, and 3*c*, crystal circuitry 8, and light sources 4, 5. In an alternative embodiment, the circuitry for medical timing apparatus 1 is implemented on a custom integrated circuit chip. In a second alternative embodiment, the circuitry for medical timing apparatus 1 is comprised of discrete components.

In addition, medical timing apparatus 1 includes a means for connecting to the foot portion of a bed. In a preferred embodiment, such bed connecting means comprises a clamp, which is made from a rigid material such as metal, fiberglass, or the like, so that the device is securely clamped into position.

In use, the health care provider initially turns on the timing apparatus using power switch 9. Next, the provider selects the desired time interval after which a medical treatment is to be performed, by activating one of switches 3*a*, 3*b*, or 3*c*. Such activation stores the selected time interval in memory, and the light associated with the activated switch is illuminated.

Thereafter, the health care provider selects the desired medical treatment to be performed at the completion of the selected time interval, by activating one of switches 2*a*, 2*b*, or 2*c*. The activation of one of switches 2*a*, 2*b*, or 2*c* activates the first time measuring unit so as to load or program the first time measuring unit with the selected time interval selected from switches 3*a*, 3*b*, or 3*c*, and to begin measuring the time interval. The light associated with the selected treatment is illuminated upon activation.

When the first time measuring unit completes the measurement of the selected time interval, in other words when the selected time interval has elapsed, the first indicating means alerts the health care provider of the completion and thus the need for performing the selected medical treatment, by illuminating light source 4; and the second time measuring unit begins measuring the predetermined time interval.

Once the health care provider is alerted, the provider thereupon performs the selected and indicated medical treatment; and selects the next medical treatment to be performed at the end of the next time interval by selecting the desired time interval (if different from the previously selected time interval) through activation of one of switches 3*a*, 3*b*, and 3*c*, and by selecting the desired medical treatment through activation of one of switches 2*a*, 2*b* and 2*c*. The activation of one of switches 2*a*, 2*b*, and 2*c* thereby reactivates the first time measuring unit so as to begin measuring the selected time interval, and turns off any activating visual indicators.

However, if the first time measuring unit is not reactivated within the predetermined time interval following the completion of the originally selected time interval, the second indicating means alerts the health care provider of a heightened need to administer the selected medical treatment, by additionally illuminating light source 5. This illumination, when detected by the health care provider, will alert the provider to administer the indicated medical treatment immediately so as to reduce the risks of any adverse effects due to the patient being in the same position for a prolonged period of time.

Although there have been described what are at present considered to be the preferred embodiments of the present invention, it will be understood that the invention can be embodied. in other specific forms without departing from the spirit or essential characteristics thereof.

For example, medical timing apparatus 1 may be associated with the treatment of patients whom are incontinent. In this embodiment, the apparatus preferably is selectively secured to both a wheelchair and a bed. Such securement means preferably but not necessarily includes hook-and-loop fastening members. Further, each of switches 2*a*, 2*b*, and 2*c* preferably but not necessarily corresponds to a different, periodic medical treatment in treating patients whom are incontinent, such as applying clean or dry clothing, applying lotion, or managing medical devices associated with caring for the incontinent. Additionally, the predetermined time intervals corresponding to switches 3*a*, 3*b*, and 3*c* may be different from the time intervals shown in FIG. 1.

Further, in another alternative embodiment, medical timing apparatus 1 preferably but not necessarily substantially automatically measures consecutive selected time intervals without the need for manual reactivation, and accordingly changes the medical treatment for a corresponding time interval to one which is distinct from a medical treatment corresponding to an immediately preceding time interval. In this embodiment, timing apparatus 1 includes a means for recording the indicated medical treatment corresponding to a particular time interval without reactivating the first time measurement means. In use, the health care provider selects the time interval and the first medical treatment which is to be performed after the first selected time interval. Thereafter, at the completion of a time interval, the apparatus substantially automatically activates the measuring of a subsequent time interval and updates the medical treatment to correspond to a different medical treatment.

The described embodiments are, therefore, to be considered in all aspects as illustrative, and not restrictive. The scope of the invention is indicated by the appended claims rather than the foregoing description.

I claim:

1. A medical timing device, comprising:

means for measuring an interval of time having a programmable duration;

means, connected to said time measuring means, for activating said time measuring means;

means, connected to said time measuring means, for selecting said programmable time duration from a plurality of first predetermined time durations;

first means, connected to said time measuring means, for indicating when said selected programmable time duration has completed; and said activation means comprises means for selecting from a plurality of predetermined medical treatments, said selected predetermined medical treatment to be performed after said completion of said programmable time duration.

2. A timing device as recited in claim 1, including:

means for determining if said time measuring means has been reactivated following completion of said selected programmable time duration; and second means for indicating the absence of reactivation after completion of a second predetermined time duration following said selected programmable time duration completion.

3. A timing device as recited in claim 2, wherein:

each of said first indicating means and said second indicating means includes a light source; and said second indicating means comprises a light source which illuminates a light having a different color than said light source of said first indicating means.

4. A timing device as recited in claim 2, wherein:

said first and said second indicating means each comprises a light source which illuminates periodically; and said light source of said second indicating means illuminates at a frequency which is different from a illumination frequency of said first indicating means.

5. A timing device as recited in claim 1, wherein:

said predetermined medical treatment selection means comprises a plurality of switches, each of said switches corresponding to an orientation in which to position a patient confined to a bed.

6. A timing device as recited in claim 5, wherein:

said orientations include positioning the patient on the patient's left side, right side, and in a supine position.

7. A timing device as recited in claim 1, wherein:

said timing device substantially automatically measures successive said programmed time intervals, with each of said successive time intervals substantially automatically corresponding to a medical treatment which is different from a medical treatment corresponding to an immediately preceding said programmed time interval.

8. A timing device as recited in claim 7, wherein:

said medical treatments comprise a plurality of periodic, daily treatments for caring patients confined to a bed, including positioning a patient on the patient's right side, left side, and in the supine position.

9. A timing device as recited in claim 1, wherein:

said device includes means for selectively mounting to a wheelchair; and said predetermined medical treatments comprise periodic treatments for the incontinent.

10. A hospital bed timing apparatus, comprising:

first timing means for measuring a programmable time period;

means, connected to said first time measuring means, for initiating a measurement of said programmable time period;

means, connected to said first time measuring means, for selecting from a plurality of medical treatments corresponding to said programmable time period, wherein said selecting means initiates measurement of said programmable time period; and first means for indicating when said first time measuring means completes said measuring of said programmable time period.

11. An apparatus as recited in claim 10, including:

means for determining if said first time measurement means was reinitiated within a predetermined time period following said completion of said programmable time period; and second means for indicating an absence of said reinitiation of said timing means within said predetermined time period.

12. An apparatus as recited in claim 10, wherein:

said medical treatments comprise a plurality of positions in which to orient a patient within a bed.

13. An apparatus as recited in claim 12, wherein:

said positions comprise orienting a patient on the patient's left side, on the patient's right side, and in the supine position.

14. An apparatus as recited in claim 11, wherein:

said first and second indicating means each comprises a light source; and said light source of said second indicating means generates a light having a different color from a light generated from said first indicating means.

15. An apparatus as recited in claim 10, wherein:

said selecting means substantially automatically initiates said measurement of said programmable time period by said first timing means, following completion of a preceding said programmable time period; and said medical treatments corresponding to successive said programmable time periods measured by said first timing means are distinct from each other.

16. An apparatus as recited in claim 10, including:

means for attaching said apparatus to a wheelchair; and wherein said medical treatments comprise a plurality of periodic treatments in caring for the incontinent.

17. A time measurement device for use in providing patient care services, comprising:

means for selecting a patient care service from a plurality of predetermined patient care services;

means for selecting a time period after which said selected patient care service is to be rendered;

means for determining a completion of said selected time period;

first means for indicating said completion of said selected time period, and for indicating said selected patient care service corresponding thereto; and second means for indicating an absence of a selection of a subsequent said predetermined patient care service within a first predetermined time period following completion of said selected time period.

18. A device as recited in claim 17, wherein:

said device includes means for securing to a hospital bed.

19. A device as recited in claim 17, including:

means for attaching to a wheelchair; and said patient care services comprise periodic services in caring for the incontinent.

20. A device as recited in claim 18, wherein:

said patient care services comprise orientations in which to position a patient confined to a bed.

* * * * *